United States Patent [19]

Mobilia

[11] 4,447,919

[45] May 15, 1984

[54] FLUSH CONTROL DEVICE

[76] Inventor: Crescenzo Mobilia, 42 Pine St., Torrington, Conn. 06790

[21] Appl. No.: 389,672

[22] Filed: Jun. 18, 1982

[51] Int. Cl.[3] ..... E03D 1/14; E03D 3/12

[52] U.S. Cl. ..... 4/325; 4/405

[58] Field of Search ..... 4/324, 325, 412–415, 4/382, 392, 393, 405

[56] References Cited

U.S. PATENT DOCUMENTS

| | | | |
|---|---|---|---|
| 2,645,780 | 7/1953 | Becker | 4/325 |
| 2,729,827 | 1/1956 | Morita . | |
| 3,744,064 | 7/1973 | Preston | 4/325 |
| 3,777,316 | 12/1973 | Coetzel . | |
| 3,823,425 | 7/1974 | Coffman | 4/382 X |
| 3,894,299 | 7/1975 | Cleary . | |
| 3,936,889 | 2/1976 | Wibroe | 4/325 |
| 4,025,968 | 5/1977 | Davis | 4/325 |
| 4,038,707 | 2/1977 | Cass . | |
| 4,067,074 | 1/1978 | Harrison . | |
| 4,086,667 | 5/1978 | Miklos | 4/325 |
| 4,117,556 | 10/1978 | Semler | 4/325 |
| 4,145,774 | 3/1979 | Sullivan . | |
| 4,149,283 | 4/1979 | Knudtson . | |
| 4,225,987 | 10/1980 | Goldman et al. . | |

*Primary Examiner*—Charles E. Phillips

[57] ABSTRACT

A device for controlling the discharge of water from a toilet tank, in either a full flush mode or a partial flush mode, utilizes an opening mechanism that produces the full flush in its normal condition and without need for any extraordinary manipulation. Shifting the operating handle inwardly, while rotating it in the customary manner, will produce a partial discharge of the contents. The device includes a biasing member, which engages a moving part of the valve assembly to exert a closing bias thereupon, but which does not unduly limit the movement of the valve plug so as to constrain it to less than a fully open position.

7 Claims, 10 Drawing Figures

FLUSH CONTROL DEVICE

BACKGROUND OF THE INVENTION

The conventional toilet tank flushing mechanism discharges substantially the entire volume of water stored in the tank, even though only a portion of that amount may be adequate in at least certain circumstances. This, of course, wastes water and imposes an unnecessary load upon the sewerage system. While devices for selectively achieving the discharge of only a portion of the water contained in the toilet tank have heretofore been proposed, they are generally found to be deficient in one or more respects.

The three configurations of valve assemblies that are perhaps most commonly utilized in the standard toilet ar described in the prior art. One configuration that is in rather widespread use is disclosed in Harrison U.S. Letters Pat. No. 4,067,074, which utilizes a gravity tube/flush valve float assembly to control the discharge of water from the tank. Another commonly employed valve assembly is shown in Cass U.S. Letters Pat. No. 4,038,707, which utilizes a vertically sliding ball valve for flow control. A somewhat similar mechanism, commonly called a "flapper" assembly, is shown in Goldman et al U.S. Letters Pat. No. 4,225,987, and employs a ball valve closure that is pivotably mounted adjacent the discharge opening.

In order to achieve a partial flush operation, many of the prior art devices designed for that purpose employ means to interrupt movement of the closure in a position that is less than fully displaced from the valve seat, as compared to the fully open position that is attained during the normal flush. This can, however, result in spurious operation, due to the failure of the closure to be removed completely from the vortex effect, causing the closure to be drawn prematurely into the valve seat and thereby terminating flow before an adequate amount of water has been discharged. Valve assemblies of the type shown in the above-identified Goldman et al patent appear to be particularly susceptible to malfunctions of this nature.

Other systems provide a partial flush mode as the norm, and are therefore found to be unsatisfactory from a conceptual standpoint, in that they demand that the user deviate from his accustomed action in order to produce the normally expected (full flush) result. This then requires that the operator be aware of the existance and operational peculiarities of the novel mechanism, and is problematical from that standpoint. Harrison, for example, requires that the handle of the flushing mechanism be pressed inwardly to obtain the normal volume discharge; a reduced flow (and hence, in many instances, an inadequate effect) would frequently be produced accidentally by a person who is ignorant of the proper manner of operating the system, or by young children and others of limited capacity.

Accordingly, it is an object of the present invention to provide a novel flush control device, and a toilet tank flushing system utilizing the same, that permits selective operation to provide either a full or a partial flush operating mode.

It is also an object of the invention to provide such a device and system which is fully compatible with a variety of flush valve assemblies of standard design, and which requires a minimum number of parts for installation and adaptation of the system.

It is another, more specific object of the invention to provide a flush control device that produces the normal, full volume discharge upon rotation of the operating handle in the customary manner, with extraordinary measures being required to initiate the partial flush cycle.

Yet another object of the invention is to provide such a device which is easily and conveniently retrofit with existing equipment.

A further object is to provide a flush control device that functions in a desirable manner, and that does not operate by preventing the valve closure from attaining a position that is fully displaced from the valve seat.

A still further object of the invention is to provide a novel device and system having the foregoing features and advantages, which are relatively economical to manufacture, durable, effective, and facile to install and to use.

SUMMARY OF THE INVENTION

It has now been found that certain of the foregoing and related objects of the invention are readily attained in a flush control device comprising an operating mechanism, a restraining arm assembly, and linkage means therebetween. The operating mechanism includes means for mounting it upon the tank of a toilet fixture, which means comprises a cylindrical sleeve member for seated engagement within an aperture through the tank wall, and a support member for the restraining arm. An operating cylinder is rotatably mounted within the sleeve member of the mounting means, and the cylinder has a bore extending axially therethrough, linkage engaging means thereon, and coupling means adjacent the outer end thereof. The actuating member is mounted outwardly adjacent the operating cylinder in the sleeve, and includes a cylindrical bearing portion supporting it for axial shifting and rotation in the sleeve between an outward, normal flush mode position, and an inward, partial flush mode position. A shaft portion of the actuating member extends through the bore of the operating cylinder, and has an end portion extending beyond the inner end thereof; the latter has a valve assembly operating arm affixed to it, which is adapted for operative connection to the valve assembly to effect displacement of the valve plug or closure from its seat in the toilet tank. Coupling means is provided on the actuating member for cooperative turning engagement with the coupling means of the operating cylinder, which engagement is achieved only in the inward position of the actuating member.

The restraining arm assembly is comprised of a valve plug biasing member constructed to engage a moveable part of the valve assembly and to bias the plug toward its closed position. The assembly is mounted on the support member of the mounting means for pivotable movement from a retracted position, with the operating cylinder of the operating mechanism in its normal position and with the biasing member withdrawn from the path of movement of the moveable part, to an extended position in which the operating cylinder is angularly displaced from its normal position and the plug biasing member is disposed in the path of movement of the valve part. The biasing member therefore engages the valve part in the course of its movement from the closed to the open positions thereof, when the restraining arm assembly is in its extended position. The linkage means operatively connects the operating cylinder to the restraining arm assemby, so as to transmit turning movement of the cylinder and thereby effect pivoting of the restraining arm assembly.

Rotation of the actuating member, in either its inward or outward position, will cause the operating arm attached to the inner end of its shaft portion to displace the valve plug from its seat. In the inward position of the actuating member, however, rotation will cause the biasing means of the restraining arm assembly to be disposed in the path of movement of the valve part, thus engaging the part and exerting a closing force upon the valve plug. The biasing means will therefore promote premature closing of the valve; consequently, it will produce a partial flush mode in which the volume of water discharged from the tank will be reduced substantially, as compared to that which would occur in the full flush mode produced with the actuating member in its outward position.

Other objects of the invention are achieved by the provision of a toilet tank flushing system which comprises, in combination with the above-described flush control device, a water discharge valve assembly, and means for operatively connecting the assembly to the operating arm attached to the shaft of the actuating member. The discharge valve assembly will comprise a valve plug, means for mounting the plug adjacent the discharge valve seat for movement along a path between a closed position seated thereon and an open position displaced therefrom, and bouyant means operatively connected to, or comprising, the valve plug, for assisting movement to its open position. The means for operatively connecting the operating arm to the valve assembly will be capable of at least initiating displacement of the valve plug from its seat.

In the preferred embodiments of the invention, the mounting means of the flush control device will additionally include first biasing means for urging the operating cylinder toward its normal position, and second biasing means for urging the actuating member toward its outward position. The support member will, in addition, desirably comprise a bracket having a mounting post offset from, and extending parallel to, the axis of the sleeve member, and the bracket may have a fixture engaged upon the cylindrical sleeve member to support the mounting rod thereof. It will also be desirable to provide an end cap engaged upon the inner end of the sleeve member, providing support for the operating cylinder against inward axial movement. The end portion of the actuating member shaft will protrude through the end cap, and will have the valve assembly operating arm disposed outwardly thereof; the cap will also have a sidewall passage to accommodate the linkage means connected to the operating cylinder therethrough. Conveniently, the coupling means on the operating cylinder and on the actuating member will comprise mated tongue and groove portions on the confronting ends thereof.

DETAILED DESCRIPTION OF THE ILLUSTRATED EMBODIMENTS

Figure 1:
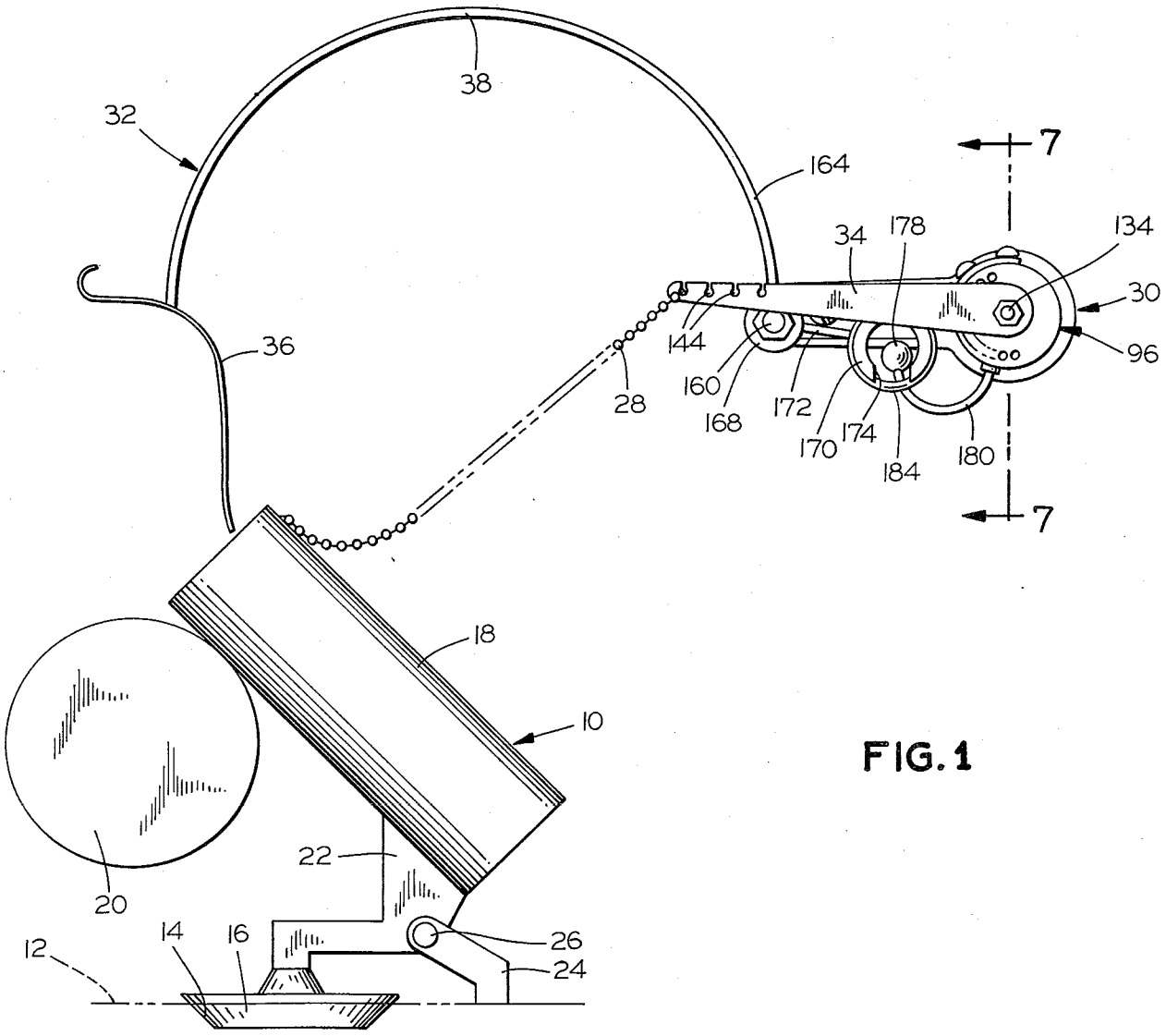
FIG. 1 is a side elevational view of a flushing system embodying the present invention, as installed in the tank of a toilet, showing the flush control device at rest and the discharge valve plug closed.
Figure 2:
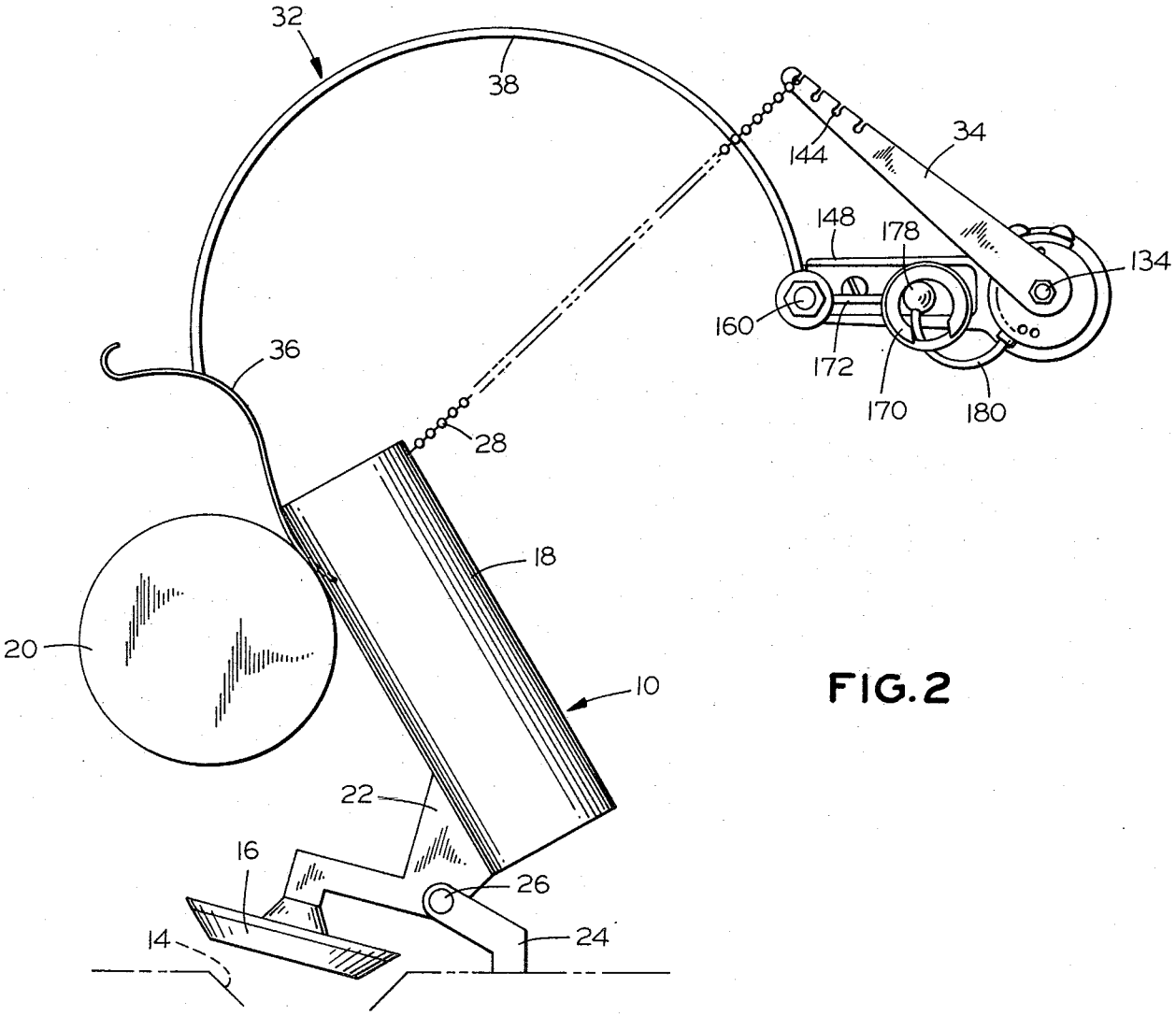
FIG. 2 is a view similar to FIG. 1, showing the parts displaced to initial positions that are attained following actuation of the operating mechanism in its partial flush mode condition.
Figure 3:
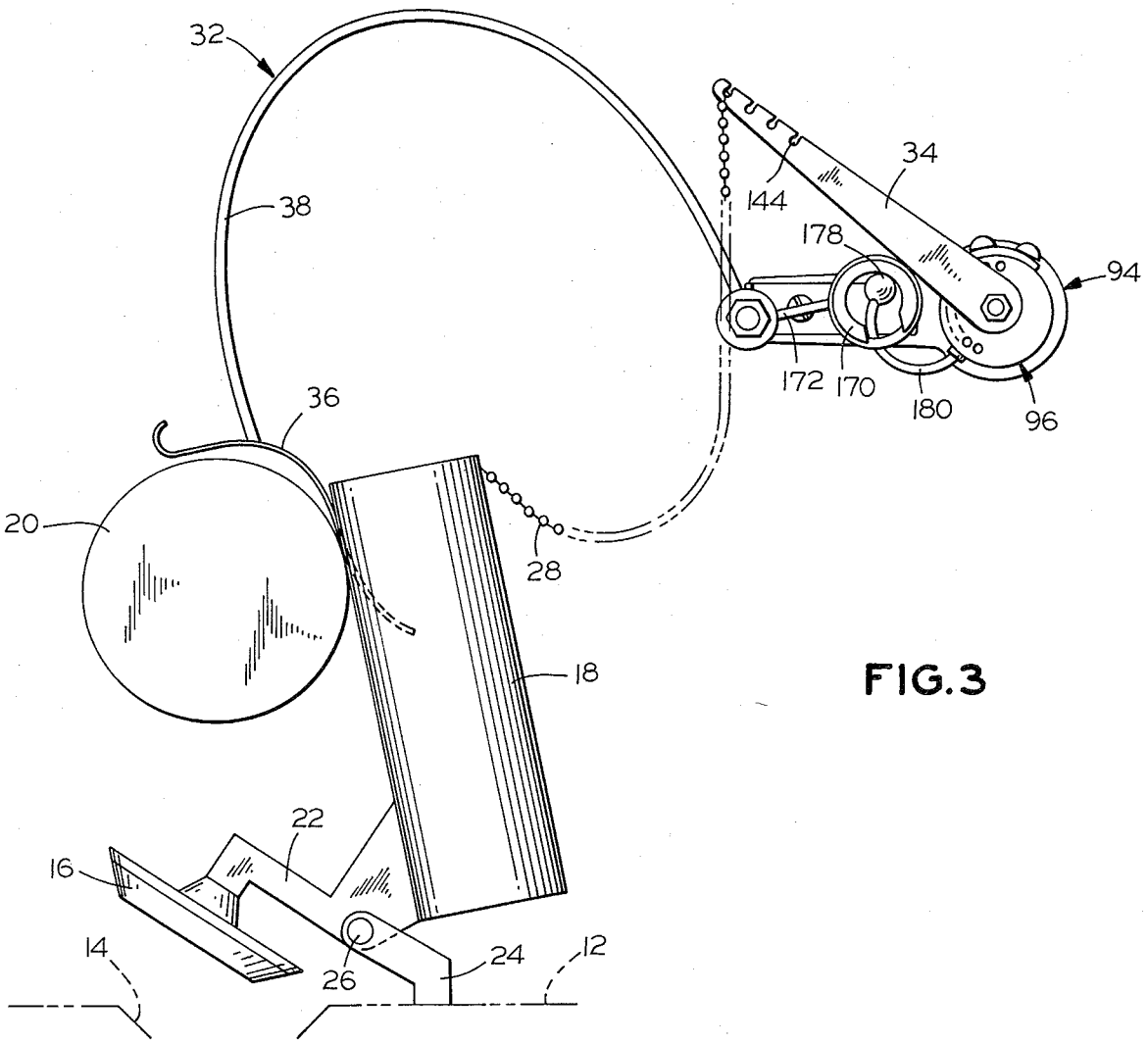
FIG. 3 is another similar view, showing the relative positions of the parts during the subsequent full flow water discharge phase of the cycle.
Figure 4:
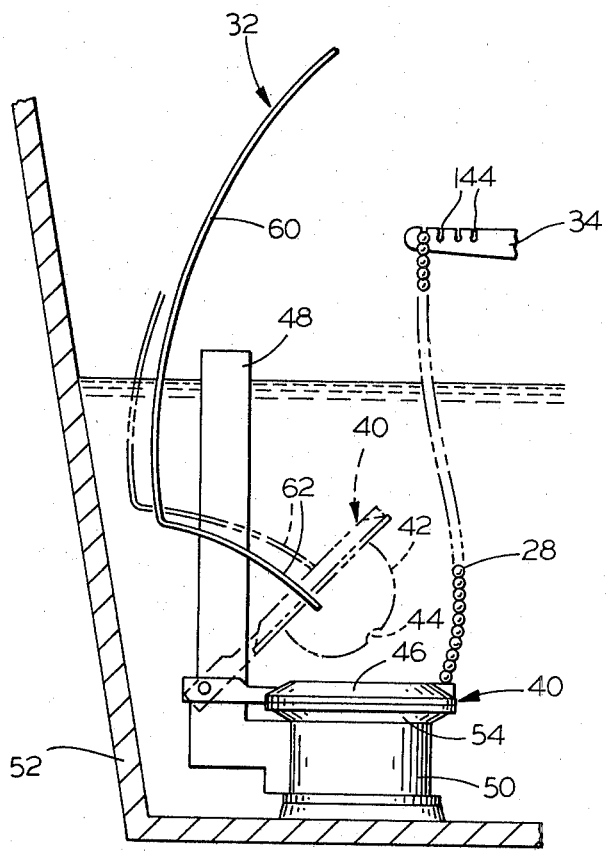
FIG. 4 is also a view similar to FIG. 1, illustrating a second type of flushing system embodying the invention, and showing the positions of the parts during phases of the partial flush mode cycle.
Figure 5:
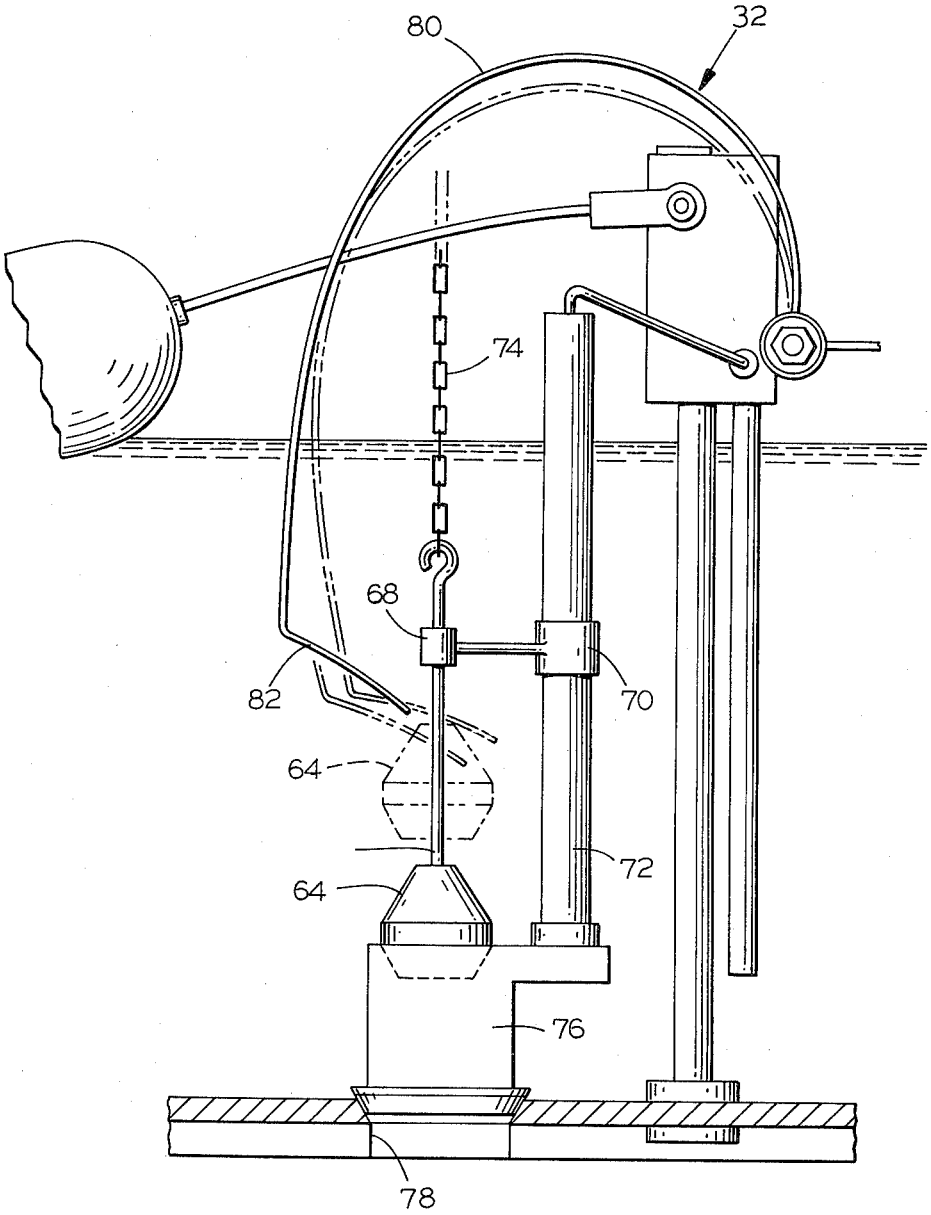
FIG. 5 is yet another similar view, illustrating operation of a third type of flushing system.
Figure 6:
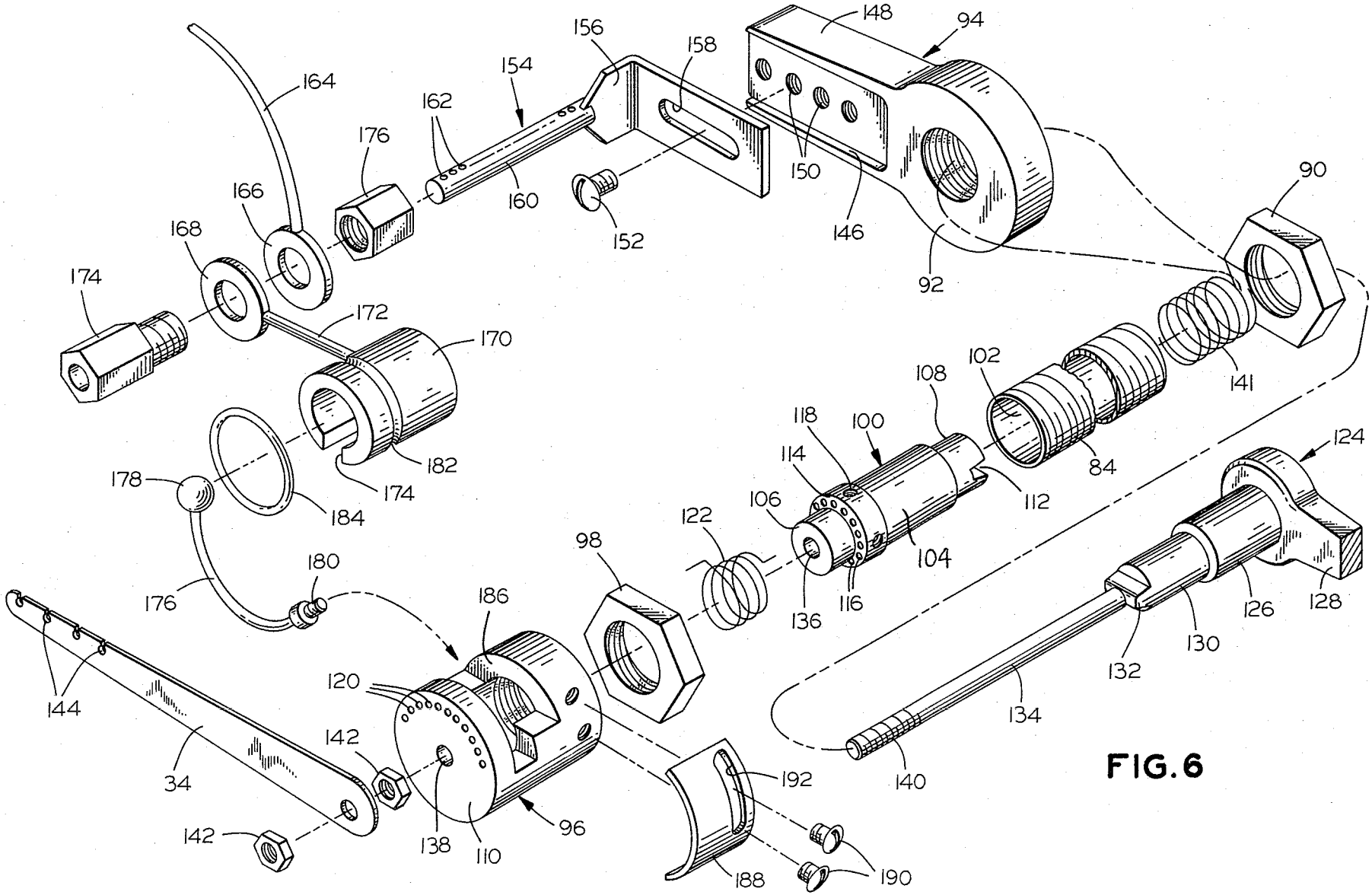
FIG. 6 is an exploded perspective view of the operating mechanism used in the flush control device of the invention.

Referring initially to FIGS. 1–5 of the drawings in general, therein illustrated are three standard toilet tank water discharge valve assemblies. While all utilize, in one form or another, a buoyant float member to either directly or indirectly control the flow of water from the tank, the construction and operation of each is quite distinct from the others. FIGS. 1–3 illustrate what is known as a "gravity tube" assembly, FIG. 4 shows a "flapper" type arrangement, and FIG. 5 shows an assembly which uses a ball valve mounted for sliding movement into and from engagement in the valve seat.

Turning in particular to FIG. 1, the valve assembly, generally designated by the numeral 10, is shown mounted upon the bottom wall 12 of a toilet tank (the remainder of which is not illustrated) adjacent the valve seat portion 14 of the discharge outlet provided therein. The assebly 10 includes a plug or closure 16, a gravity tube 18, and a buoyant float member 20. The float member 20 is attached to the gravity tube 18 by suitable means, and the latter is attached to the plug 16 through the off-set arm 22, which is in turn mounted upon the post 24 for pivotable movement about the transverse pin 26. In normal operation, the gravity tube 18 is pivoted upwardly by the chain 28 to its substantially vertical position (shown in FIG. 3), to thereby displace the plug 16 from the valve seat 14, thus permitting the water to discharge from the tank. In its upright position, the center of gravity of the water-filled tube 18 is to the right of the pivot 26, thereby cooperating with the buoyancy of the float member 20 to maintain the plug 16 in its fully open attitude. The tube 18, however, contains a small aperature (not shown) in its bottom wall, through which drainage of the water contained therewithin will occur as the water level in the tank falls. This, together with the change in the buoyant effect upon (and hence, the position of) the float member 20, will cause the balance over the pivot point 26 to shift toward the discharge opening, eventually causing the plug 16 to close upon the valve seat 14, thus terminating the flow of water from the tank.

The flush control device of this invention, as shown in association with the valve assembly 10 in FIG. 1, includes an operating mechanism, generally designated by the numeral 30, and a resiliently deformable restraining arm assembly, generally designated by the numeral 32. In operation (not illustrated) to achieve a normal, full-volume flush of the tank, the operating arm 34 is pivoted by the handle (also not illustrated) of the toilet, in a clockwise direction as viewed in the figure. This will pivot the gravity tube 18 and the float member 20 to the position of FIG. 3; however, because the restraining assembly 32 has not been actuated and is therefore left in its inoperative position (beyond the travel path of the moving parts of the assembly 10), the condition shown in FIG. 3 will not occur and the normal operating mode of the toilet will be the result.

As seen, in FIG. 2, the flush control device has rotated (in a manner to be described in greater detail hereinbelow) the restraining arm assembly 32 to a position in which the lower end of the curved head 36, which is mounted on the free end of the spring member 38, will interfere with and engage the float member 20, as the latter pivots upwardly. Eventually, the float member 20 will nest fully within the upper curved portion of the head 36, and will compress the spring member 38, as in FIG. 3. Accordingly, while not unduly constraining the valve assembly against attainment of its fully opened position, the restraining assembly, being spring-loaded in the manner described, will exert a closing bias thereupon. The buoyant force acting upon the float member 20 will therefore be overcome at an earlier phase during the flushing cycle, thus closing the plug upon the valve seat prematurely. This will, in turn, produce a reduced-volume discharge of water from the tank, and hence the desired partial flush.

A second form of tank flushing system embodying the present invention is shown in FIG. 4, which illustrates a flapper type valve assembly, wherein the closure, generally designated by the numeral 40, includes a ball plug 42 of hollow construction, which has an air hole 44 formed therethrough. The plug 42 is affixed to the top plate 46 which is, in turn, pivotably connected to the upstanding overflow pipe 48; the latter is supported upon the valve seat assembly 50, which is disposed about the discharge outlet (not visible) from the tank 52. In its normally closed position (shown in solid line in FIG. 4) the stopper 42 is received within the corresponding circular seat portion 54 of the assembly 50 to close off the discharge outlet.

Operation of the toilet handle (not shown) pivots the operating arm 34 upwardly, thereby pulling the closure 40 away from the seat 54, by virtue of connection through the chain 28 producing the normal, full-flush mode of operation. To achieve a partial flush, the spring member 60 of the restraining arm assembly is brought into operative position by appropriate use of the actuating member of the flush control device (to be described in detail hereinbelow), causing the lower portion 62 thereof to interfere with the upward pivoting action of the closure 40, contacting the upper surface of the plate 46 as it does so. This causes the spring member 60 to flex to the alternative position shown in phantom line in FIG. 4, thereby exerting a downward bias upon the closure. Consequently, as the buoyant effects diminish with the falling level of water in the tank, the bias of member 60 augments the normal closing tendency, to reseat the closure 40 at a point prior to that at which it would occur in the absence of the added biasing force. Consequently, the flow of water will once again terminate prematurely, thereby producing a reduced-volume discharge from the tank.

The system illustrated in FIG. 5 operates in a comparable manner, but is adapted to the particular form of valve shown. In this instance, the ball-shaped stopper 64 is attached to the end of a rod 66 which is, in turn, slideably mounted within the sleve portion 68 of a guide 70 mounted on the overflow pipe 72. Rotation of the toilet handle and operating arm (neither of which is shown), acting through the chain 74 connected to the hook of the rod 66, will lift the stopper 64 from its seat within the valve seat assembly 76, which is engaged within the discharge opening 78 of the tank 80. After being elevated, the buoyant force upon the ball stopper 64 maintains it above the vortex formed at the mouth of the discharge outlet of the valve seat assembly 76. As the stopper descends with the falling level of water in the tank, gravity will eventually cause it to drop into engagement upon the valve seat, to thereby terminate the flow of water.

Again, the restraining arm assembly includes a curved spring biasing member 80, the lower end of which is deformed to provide an offset foot portion 82. In the operative position of the restraining assembly, the foot portion 82 is disposed across the axis of the rod 66 (as shown in phantom line in FIG. 5), in a position to contact the upper shoulder portion of the stopper 64 as it rises through the guide 68, and to become trapped thereagainst. Upon achieving the fully displaced position (also shown in phantom line) the buoyancy of the stopper has distorted the spring biasing member 80 to the state of compression illustrated. The restraining assembly thereby applies a downward bias upon the stopper 64, once again promoting its early closure and producing a premature termination of flow.

Turning now in detail to FIGS. 6–10 of the drawings, the structure and operation of the flush control device of the invention will be described in detail. It includes an externally threaded cylindrical sleeve or bushing 84, which is mounted through an opening 86 in the wall 88 of the toilet tank, and is retained therein by threaded engagement of a nut 90 and of the internally threaded circular portion 92 of the paddle-shaped fixture, generally designated by the numeral 94, disposed on the outside and inside of the tank, respectively. Threadably engaged on the innermost end of the bushing 84 is a supporting cap, generally designated by the numeral 96, which is fixed in an appropriate position thereon with the nut 98.

An operating cylinder or rotor, generally designated by the numeral 100, is received within the bore 102 of bushing 84, and extends into the cap 96; it has an intermediate body portion 104 of substantially the same diameter as the bore 102, from both ends of which extend cylindrical end portions 106, 108 of reduced diameter. The inner end portion 106 bears upon the end wall 110 of the cap 96, and the outer portion 108 is transversely slotted to provide a groove 112. An enlarged collar portion 114 encircles the cylinder 100 at a point adjacent the inner end portion 106, and it has both axially and radially extending apertures 116, 118, respectively, formed therein. As will be noted, the end wall 110 of the cap 96 has a series of small apertures 120 corresponding to the axially extending apertures 116 in the collar portion 114; the opposite ends of the coil spring 122 are engaged therein to impart counter-rotating biasing force upon the cylinder 100 toward its normal, at rest position.

Also received within the bushing 84 is an actuating mechanism, or handle assembly, generally designated by the numeral 124, including a cylindrical body portion 126, corresponding in diameter to the bushing bore 102. An enlarged handle portion 128 is formed on the outer end of the body portion 126, and a shank portion 130, having a transverse tongue 132 on its inner end, extends from the opposite side of the body. The shaft 134 extends from the shank portion 130, through the axial bore 136 of the operating cylinder 100 and the central aperture 138 in the end wall 110 of the cap 96; it has a threaded end portion 140 which projects beyond the cap and carries the operating arm 34, which is secured thereon by nuts 142.

Figure 7:
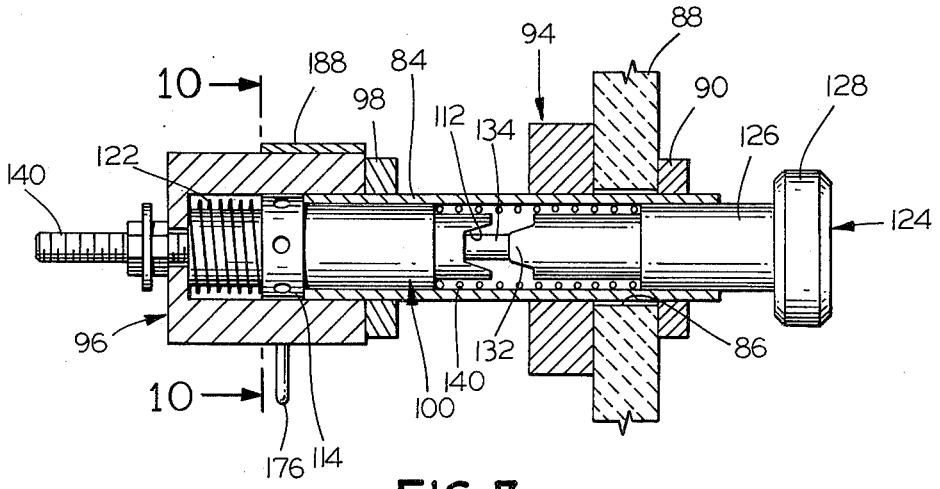
FIG. 7 is an elevational view of the actuating assembly used in the flush control device, taken along line 7—7 of FIG. 1 and drawn to a greatly enlarged scale, the actuating mechanism being positioned for normal, full flush operation.
Figure 8:
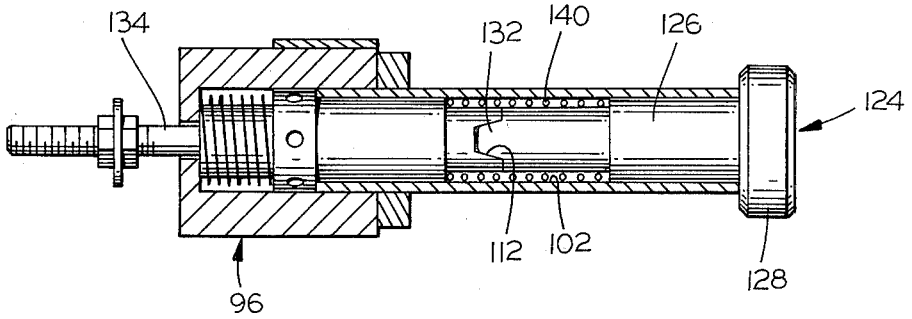
FIG. 8 is a view similar to FIG. 7, showing the actuating shaft in its depressed position, preparatory to operation for partial flushing.

The arm 34 has a series of short slots 144 formed in its upper edge, by which the pull chain 28 is secured thereto (as shown in FIGS. 1 and 4, for example). The coil spring 141, disposed within the bushing 84 about the reduced diameter end portions 130, 108 of the handle assembly 124 and the operating cylinder 100, respectively, exerts an outward bias upon the assembly. This, in turn, normally maintains the tongue 132, that is disposed thereon, out of engagement with the groove 112 of the operating cylinder 100, as illustrated in FIG. 7. Consequently, partial rotation of the handle assembly 124, in the normal manner of flushing a toilet, will elevate the arm 34, in turn actuating the valve assembly to which it is connected through the pull chain (28 or 74), in the manner previously described in with reference to FIGS. 1–5. Thus, under normal circumstances (i.e., with the actuating assembly 124 portion in its outwardly biased condition), a full flush mode of operation will be produced upon rotation of the operating handle.

The paddle shape fixture 94 has a shallow slot 146 formed into the surface of the elongated leg portion 148 thereof, which also has a series of threaded apertures 150 therethrough, which are adapted to receive the threaded fastener 152 by which the bracket support, generally designated by the numeral 154, is affixed thereon. The support 154 includes an angle brace 156, the longer portion of which is dimensioned and configured to seat within the shallow groove 146 of the fixture 94, and has an elongated slot 158 formed through it to receive the fastener 152; the support 154 can therefore be secured on the fixture 94 in any of a range of positions extended axially therefrom. The shorter leg of the angle brace 156 has a post 160 extending from it along an axis parallel to the longitudinal axis of the bushing 84 and its associated parts, which has a series of small apertures 162 formed therein; the latter serve to adjustably affix the restraining arm assembly on the post 160, in a manner that will be discussed below.

The spring biasing member (38, 60, 80) of the restraining arm assembly includes a connecting portion 164 (which may be relatively rigid), on the inner end of which is affixed a mounting ring 166. The ring 166 is mounted upon the post 160, as is the ring 168, which is attached to the coupling socket 170 through a rigid connecting arm 172. The two rings 166, 168 are held in frictional interengagement by the threaded male and female elements 174, 176 mounted upon the post 160, the bores and holes through the elements 174, 176 and the rings 166, 168 being sufficiently large to permit free pivotal movement on the post.

As can be seen, the coupling socket 170 is of generally cylindrical configuration, with an axially-extending slot 174 formed through one side. The slot 174 receives the curved linking arm 176, which has a ball 178 on one end and an threaded tip 180 on the opposite end thereof, the latter being engaged within one of the threaded apertures 118 in the collar portion 114 of the operating cylinder 100. The ball 178 is of such a diameter as will permit it to move freely within the coupling socket 170 without disengagement through the slot 174 therein. The circumferential groove 182 formed into the exterior surface of the socket 170 seats an O-ring 184, which serves to retain the arm 176 against inadvertent disassembly. It will be noted that the end cap 96 is slotted at 186 to permit passage therethrough of the linking arm 176, for attachment to the operating cylinder 100 in the manner described, with the curved stop plate 188, secured thereto by the round-head screws 190, being adjustable through the length of the slot 192 to vary the affective length of the secantal slot 186.

Thus, with the arrangement described, rotary movement of the cylinder 100 will be transmitted through the curved arm 176 to the coupling socket 170, and will in turn be transmitted through the arm 172 to the connecting portion 164 of restraining arm assembly 32 by virtue of the frictional engagement established betweeen the rings 166, 168 mounted upon the post 160. As a result, when the handle assembly 124 is shifted to its inward position shown in FIG. 8 (causing the tongue element 132 thereof to engage within the groove 112 of the operating cylinder 100) and is then rotated, the pivotal movement will be transmitted to the restraining arm assembly of the flushing mechanism (as described, for example, with reference to FIGS. 1–5), thereby simultaneously operating the arm 34 and the restraining arm assembly, to produce a partial flush discharge of water from the tank.

Figure 9:
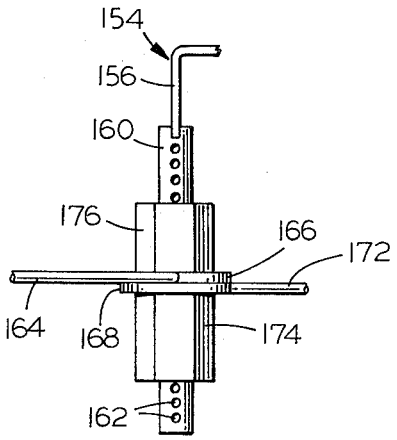
FIG. 9 is a plan view of the coupling arrangement used to connect the restraining arm assembly to the actuating linkage.
Figure 10:
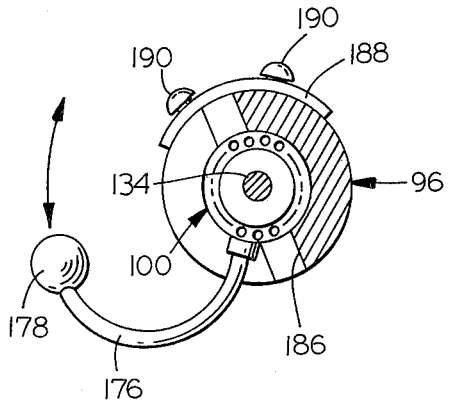
FIG. 10 is a vertical sectional view of the actuating assembly, taken along line 10—10 of FIG. 7.

FIG. 9 illustrates in greater detail the coupled engagement of the rings 166, 168 between the elements 174, 176 which are mounted on the post 160. As indicated previously, the latter has a series of small apertures 162 formed into it, which are adapted to receive small pins (not illustrated) for the purpose of positively locating the sub-assembly in a fixed longitudinal position on the post. FIG. 10 similarly illustrates in greater detail the relationships of the parts as they exist when viewed in section through the inward end of the end cap 96.

As will be appreciated, various parts of the mechanism are constructed to provide a measure of variation and adjustibility. Thus, the apertures 116, 118, 120, 150, 162, and slots 144, 158, 192, all serve that purpose. Such adjustability can, however, be eliminated in many instances, and some of the parts of the mechanism may be integrally formed rather than being made as separate pieces, such as for example the sub-assembly consisting of the bracket 154 and the fixture 94. Other modifications in the structure of the device will occur to those skilled in the art, and may be utilized without departure from the scope of the present invention. Finally, it is to be noted that the device will function by engaging any part of the valve assembly that moves with the closure, including the float (FIGS. 1–3), the stopper support plate (FIG. 4), or the stopper itself (FIG. 5), it only being required that the restraining arm be moveable to and from a position in the normal path of movement of such a part. Also, while the device operates primarily by biasing the closure toward its seated position, some limitation upon its movement, to achieve a fully open condition, may be encountered, the significant factor being that in all instances the closure will be displaced well out of the vortex zone of the discharge opening.

Thus, it can be seen that the present invention provides a novel flush control device that permits selective operation to provide either a full or a partial flush cycle. The device is compatible with the standard flush valve assemblies, and it requires a minimum number of parts for installation and adaptation to the system. The normal full flush mode is achieved by operation of the toilet tank handle in the accustomed manner, with extraordinary measures being required for initiation of the partial flush cycle. The device is easily and conveniently retrofit with existing toilet tank equipment, and it functions without preventing the closure from attaining its fully open position. In addition, the device and system of the invention are relatively economical to manufacture, durable, effective, and facile to install and to use.

Having thus described the invention, what is claimed is:

1. A flush control device for selectively operating a toilet tank water discharge valve assembly and the plug thereof in either a full or partial flush mode, comprising (a) an operating mechanism, (b) a restraining arm assembly, and (c) linkage means therebetween; said operating mechanism including:

(1) means for mounting said mechanism on said tank, and having a cylindrical sleeve member for seated engagement within an aperture through a wall of said tank, and a support member for said restraining arm assembly;

(2) an operating cylinder rotatably mounted within said sleeve member, said cylinder having a bore extending axially therethrough, linkage engaging means thereon, and coupling means adjacent the outward end thereof;

(3) an actuating member mounted outwardly adjacent said operating cylinder in said sleeve, said actuating member including a cylindrical bearing portion for supporting said actuating member for rotation and axial shifting in said sleeve between an outward, normal flush mode position and an inward, partial flush mode position, a shaft extending through said bore of said operating cylinder with an end portion projecting beyond the inward end of said cylinder, and coupling means on said actuating member end disposed adjacent said operating cylinder for cooperative turning engagement with said coupling means of said operating cylinder only in said inward position of said actuating member; and (4) a valve operating arm affixed to said projecting end portion of said shaft for operative connection to the valve assembly for displacement of the valve plug from its seat in the toilet tank;

said restraining arm assembly comprising a valve plug biasing member constructed to engage a moveable part of said valve assembly and to bias the valve plug toward its closed position, said restraining arm assembly being mounted on said support member of said mounting means for pivotable movement from a retracted position, with said operating cylinder in its normal position and with said biasing means withdrawn from the path of movement of the moveable parts of the valve assembly, to an extended position, with said cylinder angularly displaced from said normal position thereof and with said valve biasing member disposed in such path of movement, said biasing member engaging a moveable part of the valve assembly in the course of its movement from the closed to the open position of the valve plug in the extended position of said restraining arm assembly; and said linkage means being engaged with said engaging means of said operating cylinder and operatively connecting said operating cylinder and said restraining arm assembly to transmit turning movement of said cylinder so as to effect pivoting of said restraining arm assembly; whereby, upon rotation of said actuating member, in either said inner or said outer position thereof, said operating arm, connected to the water discharge valve assembly, will displace the valve plug from its seat, and whereby, upon rotation only in said inward position thereof, said actuating member, coupled to said operating cylinder and acting therethrough and through said linkage means, will dispose said biasing means in the path of movement of a part of the valve assembly to engage it and exert a closing force upon the valve plug, said biasing means thereby effecting premature closing of the valve plug and thereby producing a partial flush mode in which the volume of water discharged from the toilet tank is substantially reduced from that which would occur in the full flush mode with the actuating member in its outward position and the restraining assembly withdrawn.

2. The device of claim 1 wherein said mounting means additionally includes first biasing means for urging said cylinder angularly toward said normal position thereof, and second biasing means for urging said actuating member axially toward said outward position thereof.

3. The device of claim 1 wherein said support member comprises a bracket having a mounting post thereon offset from and extending parallel to the axis of said sleeve member.

4. The device of claim 3 wherein said bracket also has a fixture engaged upon said cylindrical sleeve member and supporting said mounting post.

5. The device of claim 1 additionally including an end cap engaged upon the inner end of said sleeve member and providing support for said operating cylinder against inward axial movement, said end portion of said actuating member shaft projecting therethrough with said valve operating arm disposed outwardly thereof, said cap having a sidewall passage to accommodate said linkage means connected to said operating cylinder therethrough.

6. The device of claim 1 wherein said coupling means on said operating cylinder and on said actuating member comprises mated tongue and groove elements on the confronting ends thereof.

7. In a toilet tank flushing system capable of selective operation to produce water discharge from the tank in either a full or a partial flush mode, the combination comprising: the flush control device of claim 1, 2, 4, 5 or 6; a water discharge valve assembly comprising a valve plug, means for mounting said plug adjacent the discharge passage valve seat of the toilet tank, for movement along a path between a closed position seated thereon and an open position displaced therefrom, and buoyant means operatively connected to, or comprising a portion of said valve plug, for promoting movement of said plug to said open position; and means for operatively connecting said operating arm to said valve assembly for at least initiating displacement of said valve plug from its valve seat.

* * * * *